US007370824B1

(12) United States Patent
Osborne

(10) Patent No.: US 7,370,824 B1
(45) Date of Patent: May 13, 2008

(54) INTELLIGENT ELECTRONIC PAPER DISPENSER

(75) Inventor: Charles Agnew Osborne, 7255 Gresham Trace, Cumming, GA (US) 30040

(73) Assignee: Charles Agnew Osborne, Cumming, GA (US)

( * ) Notice: Subject to any disclaimer, the term of this patent is extended or adjusted under 35 U.S.C. 154(b) by 428 days.

(21) Appl. No.: 11/120,732

(22) Filed: May 3, 2005

Related U.S. Application Data

(63) Continuation-in-part of application No. 10/967,976, filed on Oct. 19, 2004, now Pat. No. 7,213,782.

(60) Provisional application No. 60/540,633, filed on Jan. 30, 2004.

(51) Int. Cl.
*B65H 26/00* (2006.01)

(52) U.S. Cl. ..... 242/563; 242/563.2; 242/564.5

(58) Field of Classification Search ..... 242/393, 242/563, 563.2, 564.5, 591, 592; 340/5.9, 340/5.92; 700/236, 241, 244
See application file for complete search history.

(56) References Cited

U.S. PATENT DOCUMENTS 3,554,456 A * 1/1971 Moore ..... 242/592
4,826,262 A 5/1989 Hartman et al.
4,916,613 A 4/1990 Lange et al.
4,960,248 A 10/1990 Bauer et al.
5,031,258 A 7/1991 Shaw
5,060,877 A 10/1991 Bullivant
5,441,210 A * 8/1995 Hinton ..... 242/421.1
5,781,942 A 7/1998 Allen et al.
5,868,311 A 2/1999 Cretu-Petra
5,878,381 A 3/1999 Gemmell et al.
5,945,910 A 8/1999 Gorra (Continued)

FOREIGN PATENT DOCUMENTS

EP 0574372 12/1993

OTHER PUBLICATIONS

Notification of Transmittal of the International Search Report and the Written Opinion of the International Searching Authority for PCT/US05/02637.

*Primary Examiner*—John Q. Nguyen
(74) *Attorney, Agent, or Firm*—Womble Carlyle Sandridge & Rice, PLLC

(57) ABSTRACT

A system and apparatus for automatically dispensing a paper product mounted on a gravity-assisted holder through a dispenser. The apparatus can be pedestal or wall-mounted and includes an electric motor, a main product roller for automatically rolling a predetermined amount of the paper product from the holder, exit guide rollers for guiding the paper product through a front cover of the dispenser, and a series of interconnected gears that are driven by the electric motor to activate the main product roller and exit guide roller and operate both the main roller and exit roller at the same speed. The dispenser is activated when a proximity sensor detects the presence of an individual's hand. Operating the rollers at the same speed prevents paper or tissue jamming inside the dispenser. An even weight distribution of the paper roll against a primary roller is accomplished by offsetting the weight of the paper roll through guide tracks. When the paper roll is at full size, the center of gravity is on the guide tracks; when the paper roll gets smaller, the center of gravity shifts closer to the roller ensuring that the paper roll is fed constantly thereby increasing motor efficiency.

48 Claims, 13 Drawing Sheets

U.S. PATENT DOCUMENTS

| | | | |
|---|---|---|---|
| 5,966,753 | A | 10/1999 | Gauthier et al. |
| 6,069,354 | A | 5/2000 | Alfano et al. |
| 6,125,482 | A | 10/2000 | Foster |
| 6,179,243 | B1 | 1/2001 | Granger |
| 6,189,163 | B1 | 2/2001 | Van Marcke |
| 6,236,953 | B1 | 5/2001 | Segal |
| 6,250,601 | B1 | 6/2001 | Kolar et al. |
| 6,317,717 | B1 | 11/2001 | Lindsey et al. |
| 6,411,920 | B1 | 6/2002 | McConnell et al. |
| 6,419,136 | B2 | 7/2002 | Formon et al. |
| 7,044,421 | B1 | 5/2006 | Omdoll et al. |
| 2002/0109035 | A1 | 8/2002 | Denen et al. |
| 2002/0150198 | A1 | 10/2002 | Thompson et al. |
| 2003/0222779 | A1 | 12/2003 | Schotz et al. |

* cited by examiner

SECTION I - I

INTELLIGENT ELECTRONIC PAPER DISPENSER

CROSS-REFERENCE TO RELATED APPLICATION

This application is a continuation-in-part of U.S. patent application Ser. No. 10/967,976, filed Oct. 19, 2004 and now issued as U.S. Pat. No. 7,213,782 on May 8, 2007, which claims the benefit of U.S. Provisional Application No. 60/540,633, filed Jan. 30, 2004. U.S. patent application Ser. No. 10/967,976 is hereby incorporated by reference into this description as fully as if here represented in full.

BACKGROUND OF THE INVENTION

The present invention relates generally to systems for dispensing and, more particularly, to intelligent systems for automatically dispensing measured amounts of paper products and monitoring usage.

Whether for private home use or public use, the dispensing of paper products such as towels and tissues has resulted in many different types of dispensing devices for controlling quantities dispensed as well as for determining how efficiently the paper products are dispensed. Primarily, these dispensers use mechanical paper feeding mechanisms, actuated by the user physically touching the dispenser equipment to deliver a fixed length of paper. This bodily contact can raise concerns over hygiene when such dispensers are located in public restroom facilities, such as can be found in lodging and restaurant facilities. Additionally, out of paper or paper jam conditions have to be determined by visual inspection in public facilities, requiring periodic inspections by custodial staff.

SUMMARY OF THE INVENTION

The present invention relates to a hybrid mechanical and electronic device for dispensing paper products. In particular, the invention applies to devices for dispensing paper towels and toilet tissue in either private home or public restroom facilities, such as can be found in hotels/motels and restaurants. Both pedestal and wall-mounted units are disclosed herein. Normal home or building current or internal rechargeable or replaceable batteries powers the circuitry. The dispensing device integrates a microcomputer, coupled with electronic controls and sensors, to dispense paper and monitor the paper usage and mechanism status. Multiple dispensing devices can be networked together to report paper usage and machine status to a monitoring station.

In one aspect of the invention, an apparatus is provided for automatically dispensing a paper product mounted on a gravity-assisted holder within a pedestal or wall-mounted dispenser. The apparatus includes a paper roll shaft adapter, an electric motor, a first roller for automatically rolling a predetermined amount of the paper product from the paper roll, a second roller for guiding the paper product through a front cover of the dispenser, and a series of interconnected gears driven by the electric motor to activate the first roller and second roller to dispense the predetermined length of paper.

In another aspect of the invention, an intelligent dispensing system is provided for automatically dispensing and monitoring usage of a paper product. The system includes a paper roll shaft adapter for holding a roll of the paper product; an activation sensor to detect the presence of a user's hand in proximity to the dispenser for controlling the dispensing of paper products; a first roller for automatically rolling a predetermined amount of paper product from the roll when the dispenser is activated; a second roller for guiding the paper product through a discharge chute of the dispenser; and a motor and gearing to activate and control operation of the first roller and second roller to dispense the predetermined length of paper product through the discharge chute.

In another aspect of the invention, an intelligent dispensing system is provided. The system includes a dispenser apparatus including an activation sensor for automatically dispensing a predetermined amount of paper product in response to a detection of a user's hand in proximity to the dispenser and a microprocessor for monitoring usage of the paper product; and a free-standing pedestal for supporting the dispenser apparatus.

In yet another aspect of the invention, an intelligent dispensing system is provided, including a plurality of automatic paper product dispensers, with each dispenser including a microprocessor controller and a transceiver; a master network device operatively connected with the transceiver in each dispenser; and a local network for enabling a paper product status message to be transmitted from each automatic paper product dispenser to the master network device.

BRIEF DESCRIPTION OF THE DRAWINGS

The invention is better understood by reading the following detailed description of the invention in conjunction with the accompanying drawings.

DETAILED DESCRIPTION OF THE INVENTION

The following description of the invention is provided as an enabling teaching of the invention in its best, currently known embodiment. Those skilled in the relevant art will recognize that many changes can be made to the embodiments described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances and are a part of the present invention. Thus, the following description is provided as illustrative of the principles of the present invention and not in limitation thereof, since the scope of the present invention is defined by the claims.

Figure 1A:
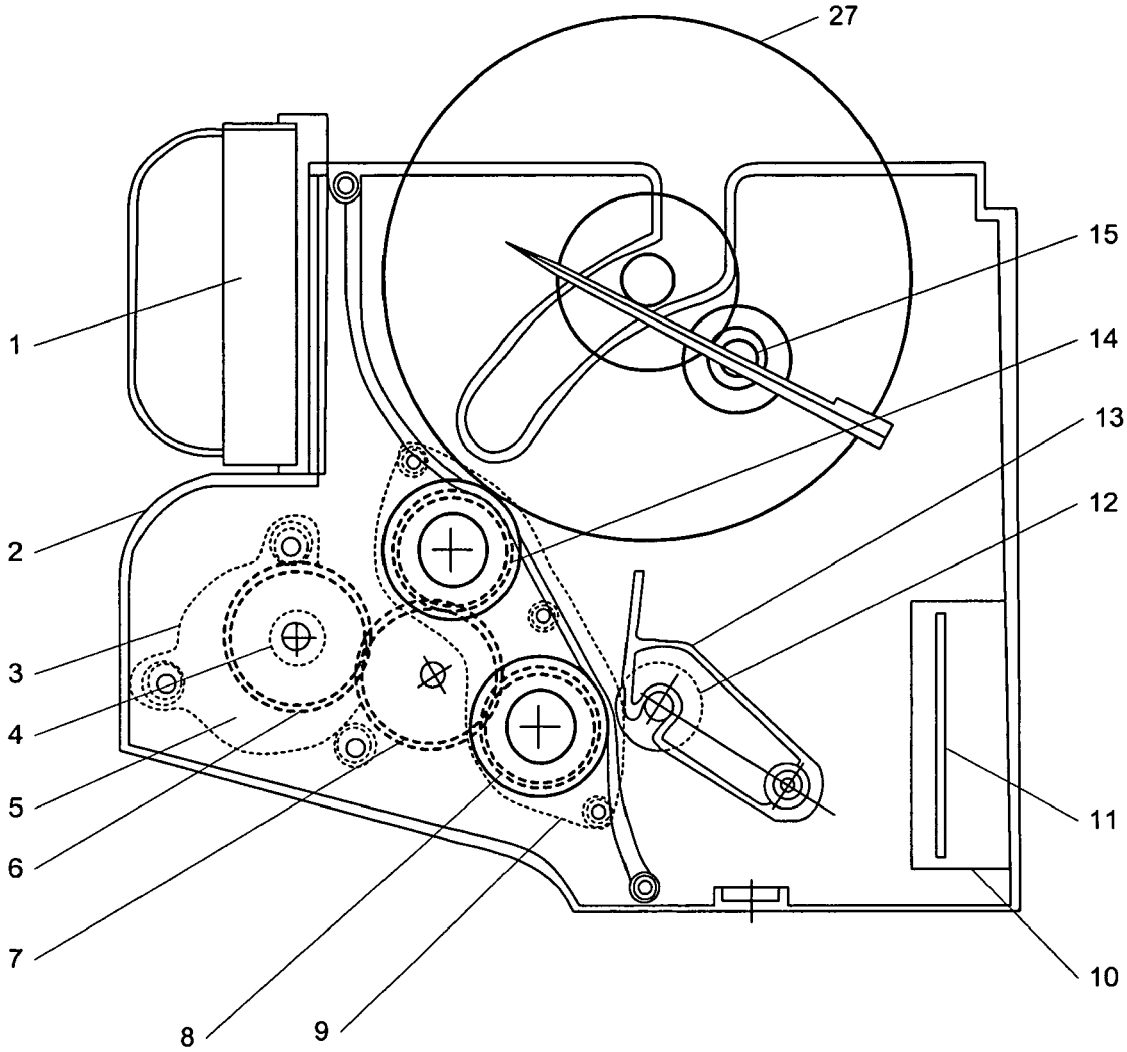
FIGS. 1A-1C illustrate several views of a gravity-assisted roll feed mechanism in accordance with an exemplary embodiment of the present invention.
Figure 1B:
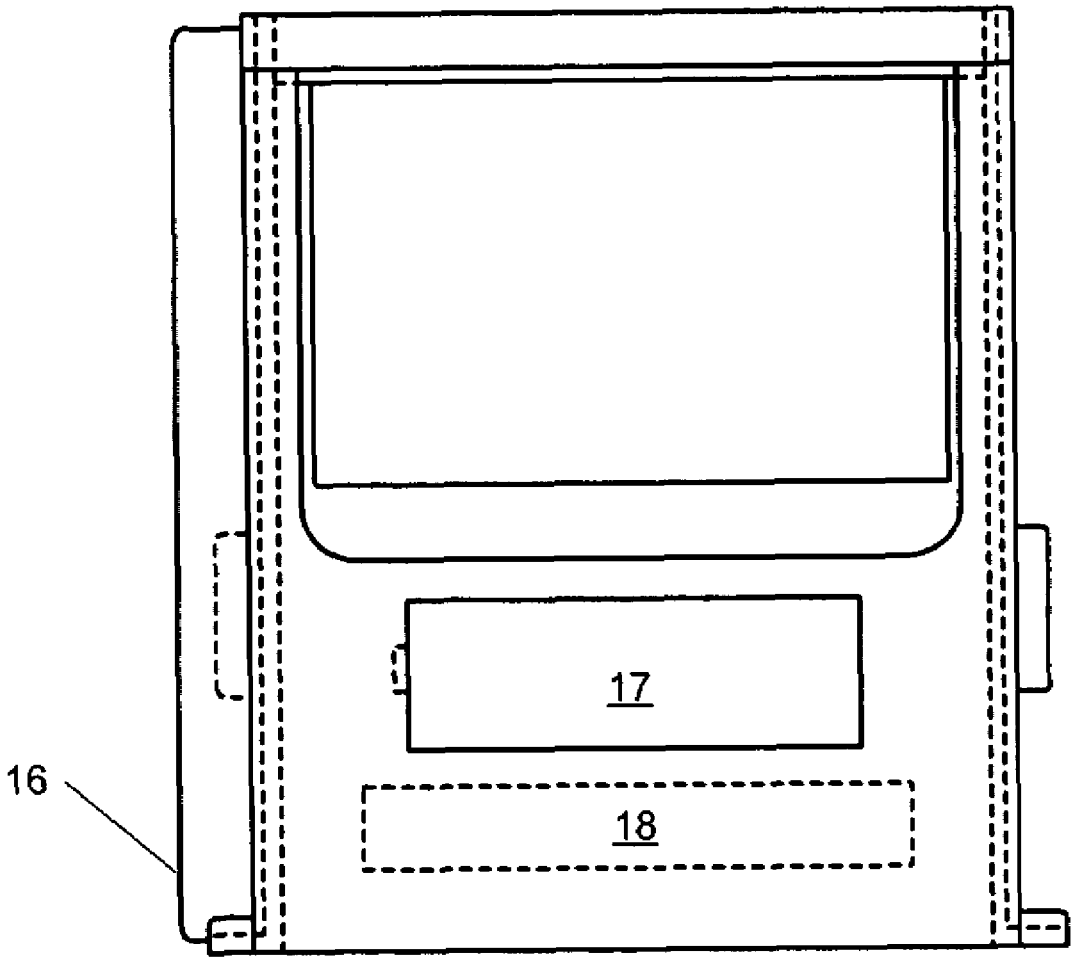
Figure 1C:
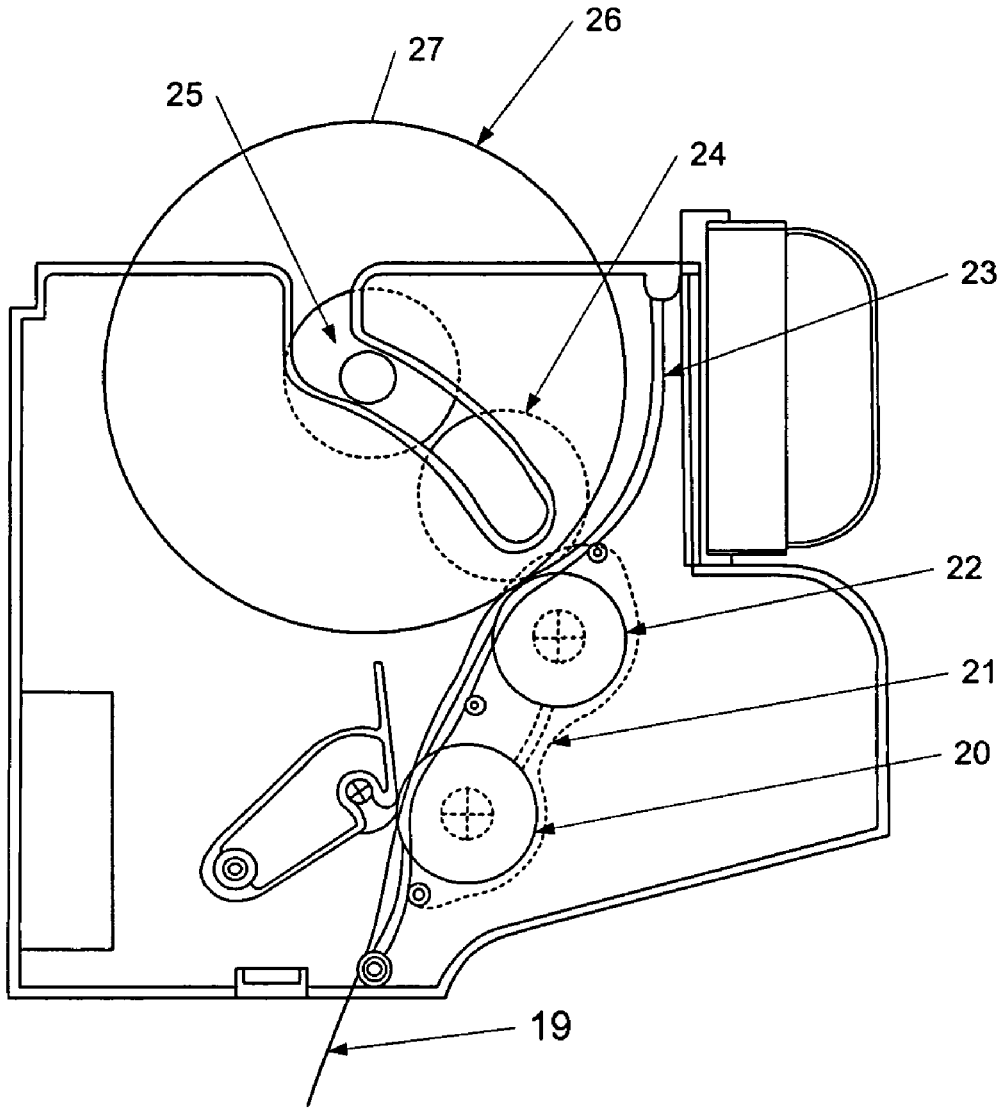

FIGS. 1A-1C illustrate a left side view, front view and right side view of the intelligent paper dispenser, respectively. As illustrated in FIG. 1A, an electric motor 5 and the associated gears 6, 7, 8, 14 in gear enclosure 16 (FIG. 1B) turn the pressing roller 12 and the driving rollers 20, 22 simultaneously for paper 19 evacuation through a discharge chute. The driving roller 22 rolls the actual paper roll 27 while the pressing roller 12 and driving roller 20 guide the paper 19 through the front cover of the dispenser chute for presentation to the user. The gravity assisted roll and feed mechanism of the invention dispenses the paper tissue in a manner that is quite different from the prior art. The prior art requires that the tissue must be pulled from the actual paper roll 27 utilizing only an exit roller. The roll and feed mechanism of the invention allows the paper tissue to be rolled automatically and fed to the user more efficiently. The paper tissue length dispensed is adjustable and metered by the pressing roller 12. The amount of paper tissue and battery usage is recorded and monitored in "real time". The amount of paper tissue remaining on paper roll 27 as well as battery life and dispenser open/closed status are displayed on a liquid crystal display (LCD) 17 on the front panel of the dispenser (shown in FIG. 1B).

The disclosed dispensing mechanism can be used to dispense a wide variety of paper products including wet towels. The intelligent paper dispensers are battery powered and/or AC adapted. A replaceable or rechargeable battery can be used and sized for the power demand of the dispenser electronics. The gravity assisted roll and feed mechanism of the invention allows automatic dispensing of tissue from paper roll 27 unlike that used in the prior art. The prior art requires that the tissue be dispensed manually. Thus the roll and feed mechanism of the invention allows even a single ply tissue to be rolled automatically and fed to the user efficiently without tearing.

With further reference to FIGS. 1A-1C, the gravity-assisted roll feed mechanism of the invention uses an electric motor 5 in dispenser 2 to turn the series of gears which activates the pressing roller 12 and driving rollers 20, 22. The pressing roller 12 and driving rollers 20, 22 operate at the same speed to ensure paper uniformity during evacuation eliminating product over spin which leads to lower incidence of product misfeeding and or jamming. A consistent friction coefficient between the driving roller 22 and the towel/tissue on paper roll 27 (as the diameter/weight of the product changes) is maintained by changing the angle of the paper on roll 27 as applied to the driving roller 22. The gravity assist roll and feed mechanism utilizes the gravity as "free energy" to create the friction required to roll the product roll 27 on the driving roller 22 limiting the friction required to feed the product by pressing roller 12 and driving roller 20, hence providing a more efficient and consistent way to dispense paper. Consistent coefficient of friction in the present context does not mean a constant coefficient of friction between the roll of paper and main roller. It simply means that as the roll of paper is dispensed, the coefficient of friction does not make any radical or extreme changes.

As further illustrated in FIGS. 1A and 1C, motor 5 drives motor gear 6. Motor gear 6 engages and drives middle gear 7. Middle gear 7 drives gear 14 for the paper driving roller 22. Middle gear 7 also drives gear 8 for the paper rollers 12, 20. The paper dispensed 19 (also referred to as "outing" paper) is roll fed by gear 8 between the pressing roller 12 and the outing roller 20. The pressing roller 12 is supported by bracket 13. Also illustrated in FIG. 1A is battery enclosure 1, motor cover 3, motor axis bushing 21, and left roller cover 9. FIG. 1 C also depicts right roller cover 21, leading plate for outing paper 23, beginning paper roll 26, ending paper roll 24, and pedestal 25.

The intelligent paper dispenser can be battery powered and/or AC adapted. Use of a battery eliminates the need to make modifications to the structure to install power wiring, thus reducing installation costs to the consumer. A rechargeable battery, such as a nickel metal hydride (NiMH) battery, can be used and sized for the power demand of the intelligent dispenser's electronics. NiMH batteries, unlike nickel cadmium batteries, are also environmentally friendly. Battery life expectation is calculated to be approximately two to six months depending on usage. A sleep mode can be activated during unoccupied hours to prolong battery life. Replaceable batteries can also be used.

An IR sensor mounted in the front panel of the dispenser senses the presence of a person's hand in proximity to the dispenser. The microprocessor collects and calculates the dispenser data and status and can transmit data to a network device in a networked environment including multiple dispensers. In a networked environment, each intelligent dispenser has an addressable code to uniquely identify it.

The readout on the LCD panel 17 (FIG. 1B) provides an indication of power status and paper status. The power status indicator provides a measure of the battery power and provides a warning of low battery. The paper status indicator can show the paper usage and status, such as paper jam, out of paper, etc. The user can locate his hand under the dispenser to dispense the paper.

In an exemplary embodiment, selectable pins or toggle switches inside the dispenser can be used to set sensing distance and length of paper to dispense. As an example, the sensing distance (to detect the presence of a user) could be set to (1) less than or equal to 40 mm. or (2) less than or equal to 70 mm. The length of paper to dispense could be set to a maximum of 20 inches if the individual places his hand in front of an activation sensor for a threshold amount of time. These distances and lengths are design considerations for a particular installation and other settings can be used as appropriate. The paper dispenser is not active when the dispenser cover is opened.

After detecting the presence of a hand and dispensing paper, the dispenser 2 will not dispense additional paper until after the previously dispensed paper is torn off from the dispenser. A sensor mounted at the discharge throat detects the presence of paper after each dispensing. If no paper is detected, there could be a paper jam inside the dispenser, the paper could be broken, or the paper could be completely used. The dispenser will stop operating if any of these conditions occur. This paper jam condition can be reported to the network in a networked environment and indicated locally on the LCD display 17.

When a paper roll is installed within the intelligent paper dispenser, the LCD display 17 will indicate 100% on all size paper rolls. The percent remaining will automatically be sensed and the LCD readout changed as the installed paper is used. In an exemplary embodiment, the LCD will provide a preliminary warning indicating that the remaining paper has reached 10%. When the LCD readout shows 0%, the dispenser will provide an out-of-paper warning. However, the dispenser 2 will stop working only when the sensor at the discharge throat fails to detect paper after each discharge. The percent of paper remaining and out-of-paper conditions can be reported to the network in a networked environment.

The LCD remaining paper display, in an exemplary embodiment, will decrease in 1% intervals from 100% when the paper roll is installed to 0% when it is determined by a microprocessor controller that the paper roll is empty. A battery usage indicator on the LCD display 17 includes a battery symbol and a number of bars (e.g. 4 bars) to indicate the remaining charge, in a manner similar to cell phone battery charge displays. The LCD display 17 will display an alarm when the battery needs to be changed or charged. The LCD display 17 will normally be a ready mode indication. During normal working conditions, the LCD display 17 will show the battery charge remaining and the paper remaining in the dispenser. During abnormal working conditions, there could be a battery alarm, a paper remaining at 10% warning, an end of paper alarm or a paper stopped alarm when there is a paper jam or broken paper inside the dispenser.

Opening the cover of the dispenser will prepare the dispenser for loading the tissue. The tissue core shaft/adapter is inserted in the core of the tissue. The core shaft/adapter can accommodate almost any brand of tissue. Before placing the tissue in the dispenser, the first few sheets need to be separated from the paper roll. The tissue is then placed in the dispenser 2 so that the paper is in contact with both driving rollers 20, 22 inside the dispenser, with the leader paper 19 at the discharge chute. Closing the cover of the dispenser causes the pressing roller 12 to automatically engage with the driving roller 20. The dispenser 2 is now ready for use. A limit switch is activated by the closure of the cover. Once the cover is opened, the limit switch will deactivate the dispenser for safety.

The even weight and distribution of the paper roll against the primary driving roller 22 is accomplished by offsetting the weight of the roll through guide tracks. When the paper 26 is at full size, the center of gravity is on the tracks. When the paper roll 24 gets smaller, the center of gravity shifts closer to the roller 22. This ensures that the tissue is rolled constantly throughout the life of the roll, maximizing motor efficiency.

A microprocessor-based controller oversees all the control and monitoring functions. A two position DIP switch allows switching of the sensing distance between the hand and the activation sensor. The two selectable positions are 0-40 mm and 0-70 mm.

The location of the activation sensor is conveniently placed below the LED display, just above the discharge path of the paper. The sensing time duration and the paper discharge length are in direct proportion to allow the individual using the dispenser to control the amount of tissue received, as well as to save on tissue usage. In an exemplary embodiment, the maximum length of tissue dispensed at a time can be set to 20 inches, which corresponds to an individual placing his hand in front of the activation sensor for 1.6 seconds or longer. If the individual places his hand in front of the sensor for less time, a shorter length of tissue will be dispensed. For example, holding a hand in front of the activation sensor for approximately 0.8 seconds will result in approximately 10 inches of tissue being dispensed.

Once a new roll of paper is installed, regardless of paper type or size, the indicator will show the paper level at 100%; the usage displayed on the LCD 17 is reduced 1% at a time. When the paper level is less than 10%, the LCD 17 will flash the percentage amount of paper remaining until there is no additional paper. Once the paper is completely used, the LCD will flash "out of paper."

The paper counter 15 consists of a potentiometer and an arm. The arm is positioned by the paper roll shaft/adapter as it travels down the curvature toward the driving roller 22. As the potentiometer is rotated, it sends a proportional signal that responds to the angle of rotation of the potentiometer shaft, or the downward action of the arm. The curvature in the position of the arm and the potentiometer work together to produce a linear representation of the amount of paper remaining in the dispenser. Once the paper is free loaded and the dispenser is closed, the microprocessor-based controller will reset the paper level counter to 100%.

When a hand activates the sensor, the dispenser will dispense the tissues. The dispensed paper/tissue must be removed from the dispenser in order for more tissue to be dispensed. If the paper is not removed, the dispenser will be deactivated and the LCD display will indicate "remove tissue." A sensor is mounted at the discharge throat of the paper path to sense paper being discharged to make sure the paper is removed before the next cycle can be started. This prevents accidental discharging of the paper. An amount of dispensed paper between 0-4.5 inches in length can be left unremoved and the dispenser will still function normally.

When the paper level says 0% and no paper passes by the discharge sensor after the activation sensor senses the presence of a hand, the LCD will display a flashing "out of paper" indication and the unit will stop functioning.

Within one second after the sensor senses the presence of a hand, the paper will be dispensed. If paper does not dispense, the paper sensor does not sense the paper and the LCD will display a flashing "paper jam." The dispenser unit will then stop functioning.

The battery level is indicated by four bars on the LCD. As the battery level gradually lowers, the indicator bars will be reduced gradually one bar at a time. When there is only one bar left on the LCD display, the "change battery" indication will light up on the LCD and flash.

The dispenser 2 is normally in the "sleep/snooze" mode in an exemplary embodiment. The dispenser changes state from "sleep/snooze" mode to "standby" mode for a duration of five milliseconds (ms) every 495 ms. At that time, the activation sensor will be in the ready mode. All other parts/functions of the unit will remain in the "inactive" mode. If within the 5 ms "standby" mode, the activation sensor does not sense the presence of a hand, the dispenser will reenter the sleep/snooze mode again. If the activation sensor does sense the presence of a hand when in the "standby" mode, the dispenser module will dispense paper.

The electric current consumption is 200 μA when in the sleep/snooze mode; less than or equal to 15 ma when in the "standby" mode and less than or equal to 500 ma when in the "ready mode".

The dispenser 2 is battery powered. In exemplary embodiments, the dispenser can take four D size alkaline batteries or four NiMH batteries. The alkaline batteries are 6 v and the NiMH batteries are 4.8 v. The dispenser module can also accept an AC/DC converter with a DC plug. When a DC plug is connected to the dispenser, the battery will stop supplying electricity. The control circuitry automatically adjusts to the power for the other two different types of batteries.

Figure 2A:
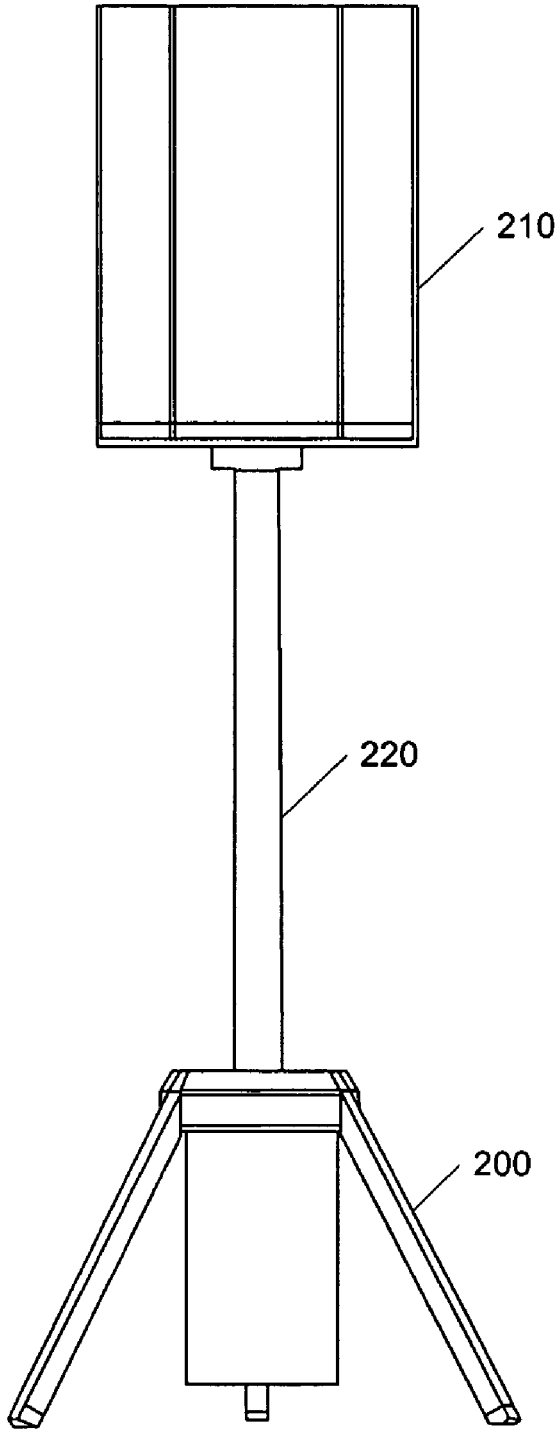
FIGS. 2A-2C illustrate several views of a pedestal mount for the gravity assisted roll feed mechanism of the present invention including a DC plug and DC jack in the section view.
Figure 2B:
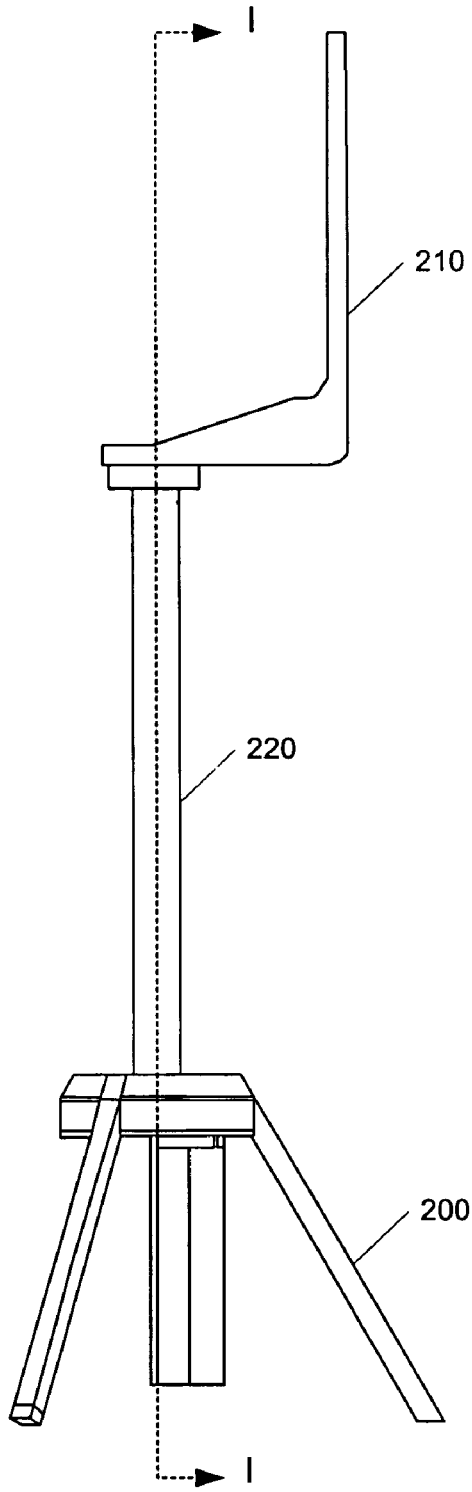
Figure 2C:
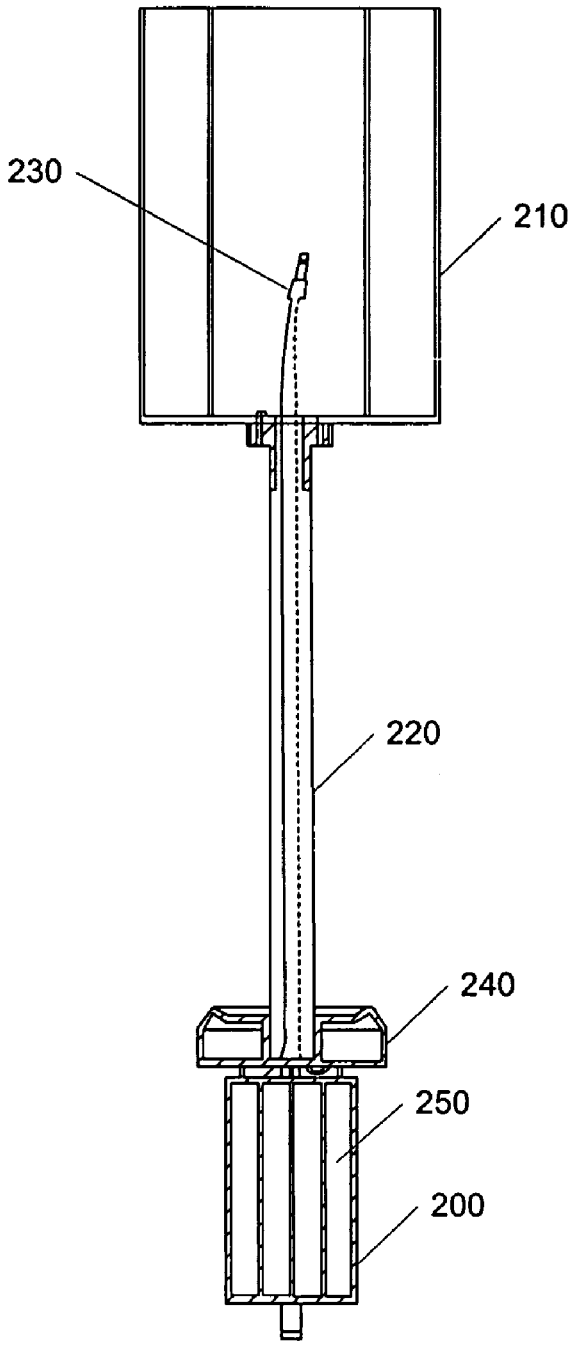

FIGS. 2A-2C illustrate a front view, side view and section view of an exemplary pedestal mount for the intelligent paper dispenser. The views in FIGS. 2A-2B are shown with the paper dispenser cover removed. FIGS. 2A-2B depict a tripod type base support 200, a pedestal shaft 220 and a rear support 210 for the pedestal cover in which the intelligent paper dispenser 2 is mounted. Section view I-I, taken through the side view illustrated in FIG. 2B, is depicted in FIG. 2C. This section view shows DC plug 230, DC jack 240 and cell box 250.

Figure 3A:
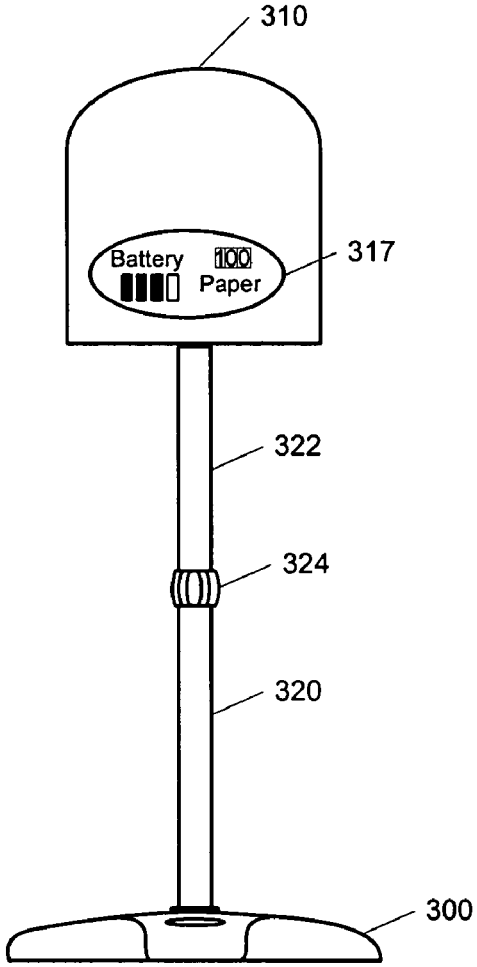
FIGS. 3A-3H illustrate various exemplary embodiments of pedestal mounts for the intelligent paper dispenser of the present invention.
Figure 3B:
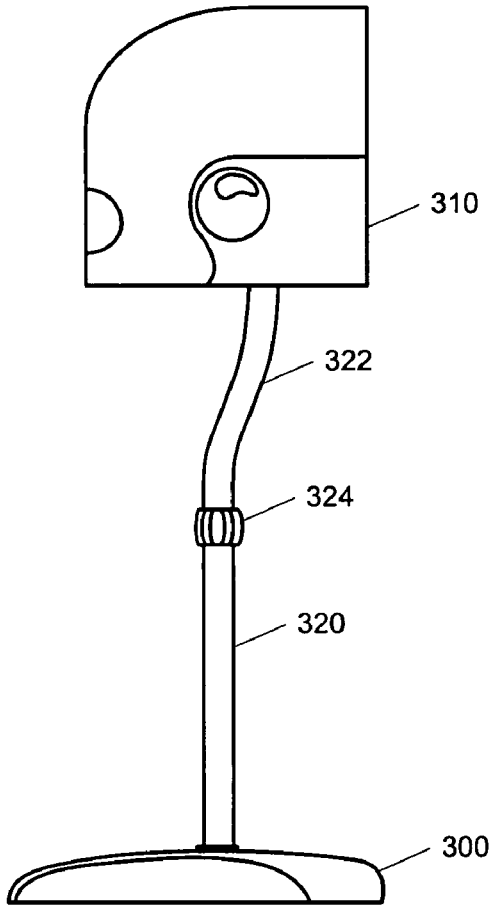
Figure 3C:
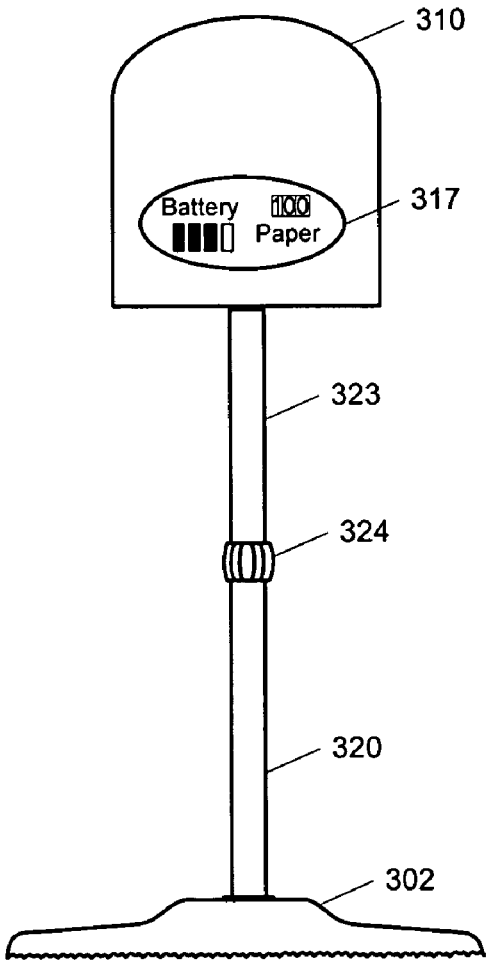
Figure 3D:
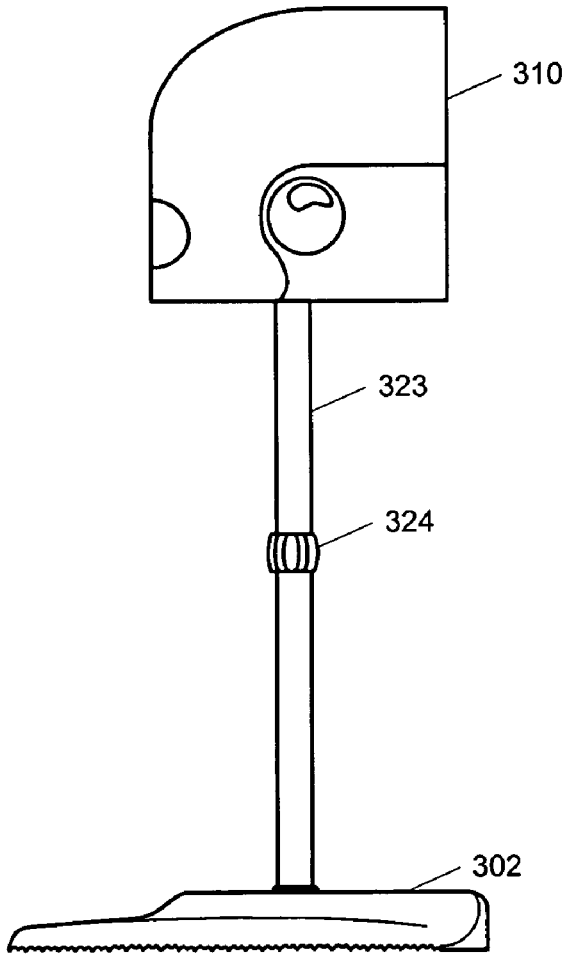
Figure 3E:
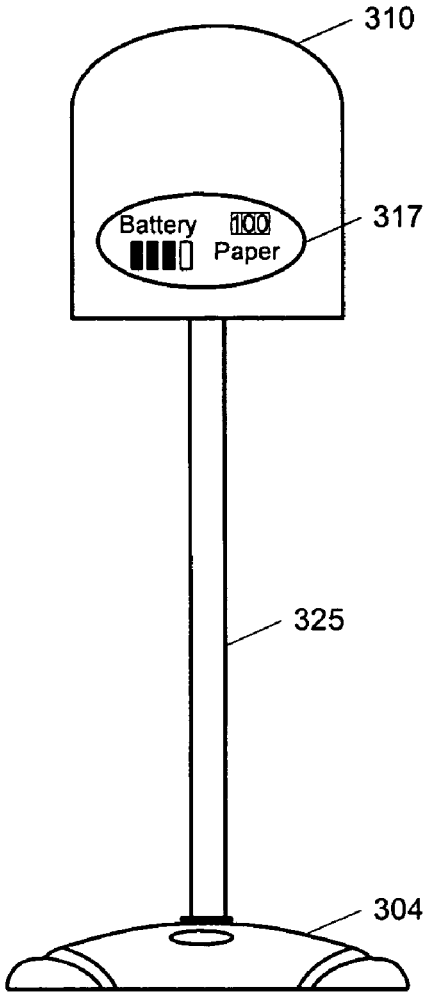
Figure 3F:
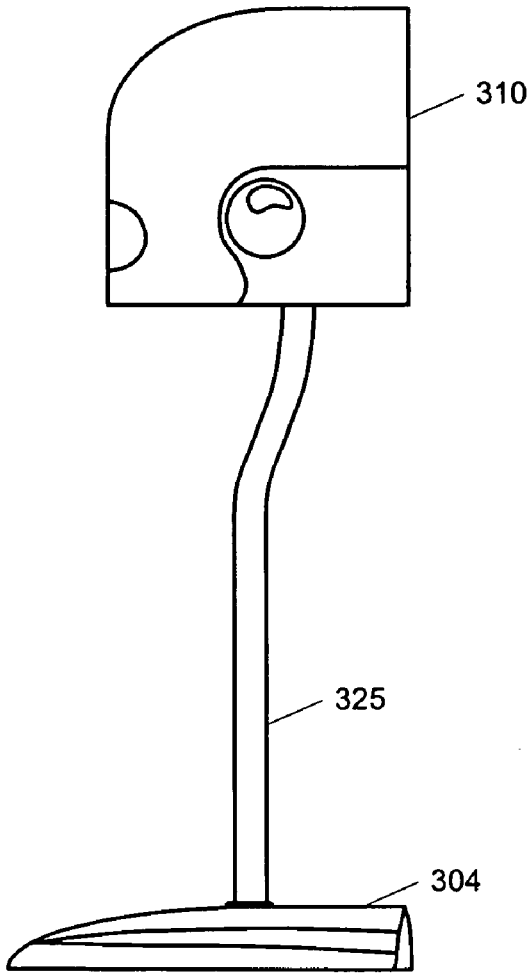
Figure 3G:
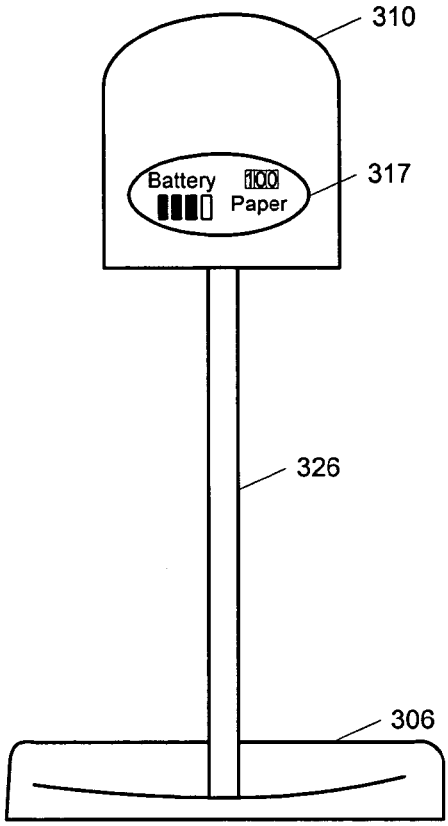
Figure 3H:
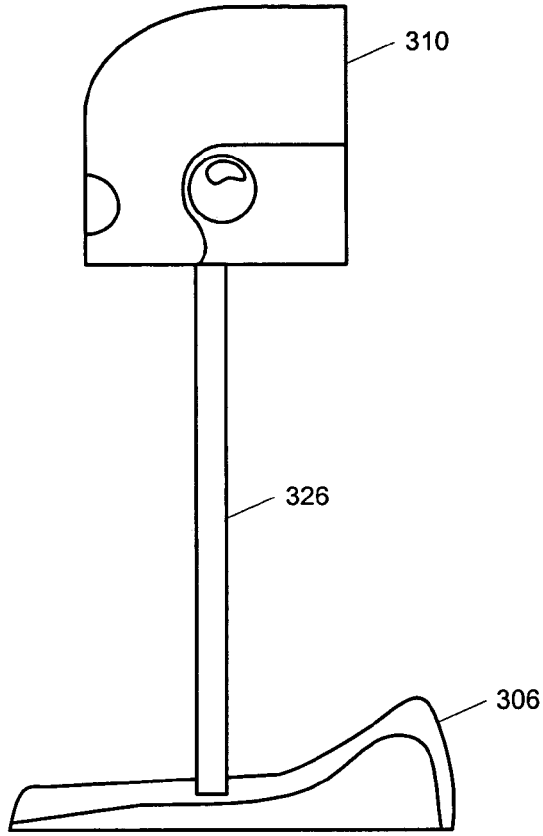

FIGS. 3A-3H illustrate several embodiments of the pedestal for the intelligent dispenser. FIGS. 3A-3B illustrate front and side views of an exemplary telescopic pedestal having a curved or angular upper shaft section 322 and a straight lower shaft section 320 supported in base 300. Height adjustment mechanism 324 serves to lock the shaft sections and to unlock them for height adjustment. LED display 317 in the pedestal paper dispenser cover 310 provides an indication of paper remaining and battery status. FIGS. 3C-3D illustrate front and side views of an exemplary telescopic pedestal having a straight upper shaft section 323 and a straight lower shaft section 320 supported in base 302. Adjustment mechanism 324, dispenser cover 310 and LED display 317 are also shown. FIGS. 3E-3F illustrate front and side views of an exemplary pedestal having a single shaft section 325 that is curved at an upper portion and supported in base 304. FIGS. 3G-3H illustrate front and side views of an exemplary pedestal having a single straight shaft section 326 that is supported in base 306. Pedestal cover 310 and LED display 317 are the same as in each of the other exemplary embodiments.

The invention provides a mechanism for automatically controlling the dispensing of paper products. Although the embodiments disclosed herein can be used in a system for dispensing paper towels and toilet tissue in facilities such as restrooms, the concepts are applicable to other types of automatic paper dispensing and metering applications. The embodiments disclosed herein are particularly suited for use in buildings such as hotels having a private bathroom in each room and distributed over multiple floors in which an intelligent dispensing network system (IDNS) detects and reports empty dispensers, paper levels, paper jams, power levels, losses, and vandalism. Real time monitoring of each dispenser in the system allows total control of an entire facility's bathroom/restroom paper requirements.

In a network environment, each dispenser control can have a data communications network interface. The network allows the dispenser status to be monitored on a continuous basis from any number of remote terminals, including handheld computing devices. This ability to monitor the usage and status of each paper dispenser yields greater user satisfaction. The custodial staff can maintain the dispenser in proper service condition with minimal down time by having instant notification of paper outages or malfunctions. Although clearly beneficial in a hotel or restaurant environment, a large home having multiple bathrooms could also benefit from a local area network to monitor paper usage and dispenser status.

Each dispenser with its associated network interface and application program forms one device within a bi-directional local communications network. Connection to this network can be via one or more media types; e.g., wire, radio frequency (RF) or infrared (IR). The dispenser status and monitored values are converted to digital form and the data is transmitted via the network. Additionally, configuration parameters for the operation of the dispenser can be received via the network. A collection of dispensers communicates over this network to a master network device that acts as the server for the local network. The master device interprets the data and manipulates it for rebroadcast to a separate and independent building automation network. The master device thus acts as a gateway between the local dispenser network and any other network protocol. The master device can also broadcast to a handheld computing device using the same or different network media type.

Figure 4:
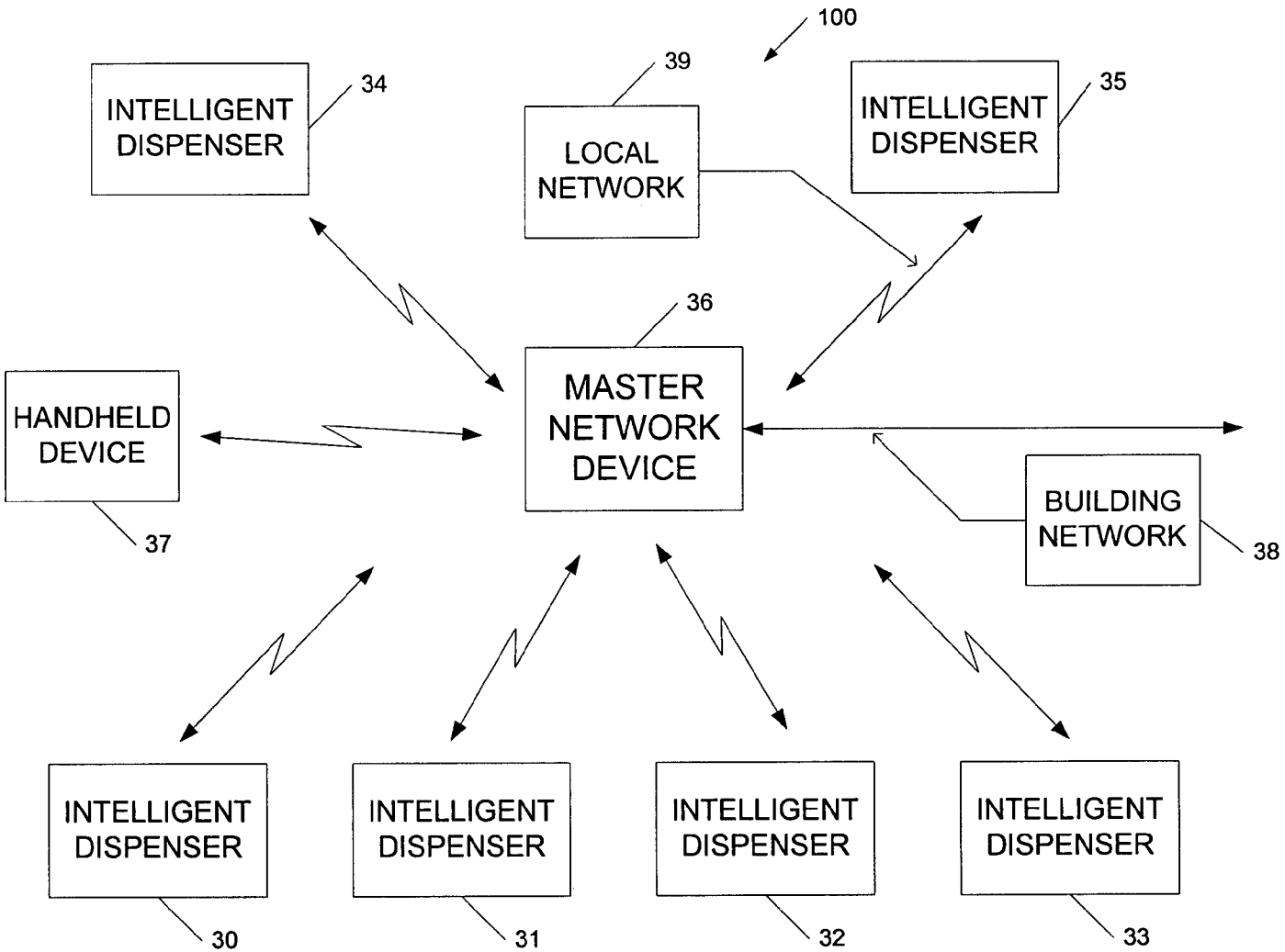
FIG. 4 illustrates a physical and logical layout for the intelligent dispensing system in accordance with an exemplary embodiment of the present invention.

FIG. 4 illustrates the layout of the intelligent dispenser network system (IDNS) 100 for automatic monitoring and dispensing in an exemplary network embodiment. This layout exemplifies a simple installation scenario, although other, more complex arrangements and combinations are possible and within the scope of the invention. The IDNS 100 is a collection and combination of the intelligent dispensers 30-35, master network device 36, and handheld device 37. This collection of intelligent dispensers 30-35 and master network device 36 forms a local dispenser network 39 and can be confined to a specific floor or other area requiring the dispensing system. With the selection of the appropriate communications medium, rooms on other floors of the building can be included in separate local networks. Multiple local IDNS networks 100 can be coupled to a building communications network 38 through the master network devices 36.

The network communications medium (i.e., the data signal path) between the master network device 36 and the dispensers 30-35 can be wire, radio frequency (RF) or infrared (IR). The network medium is selected to yield the highest network performance given the architectural construction and limitations of the space. The communications protocol used with the local dispenser networks can be a proprietary method or one of many recognized standard protocols.

A PDA 37 or similar device with a supported transceiver can be used to retrieve data from any floor, area, and room having a master network device 36. The handheld device 37, such as a PDA, is brought within transmission distance of the master network device 36. Bi-directional communications is possible to download current dispenser status and upload dispenser operational parameters.

Figure 5:
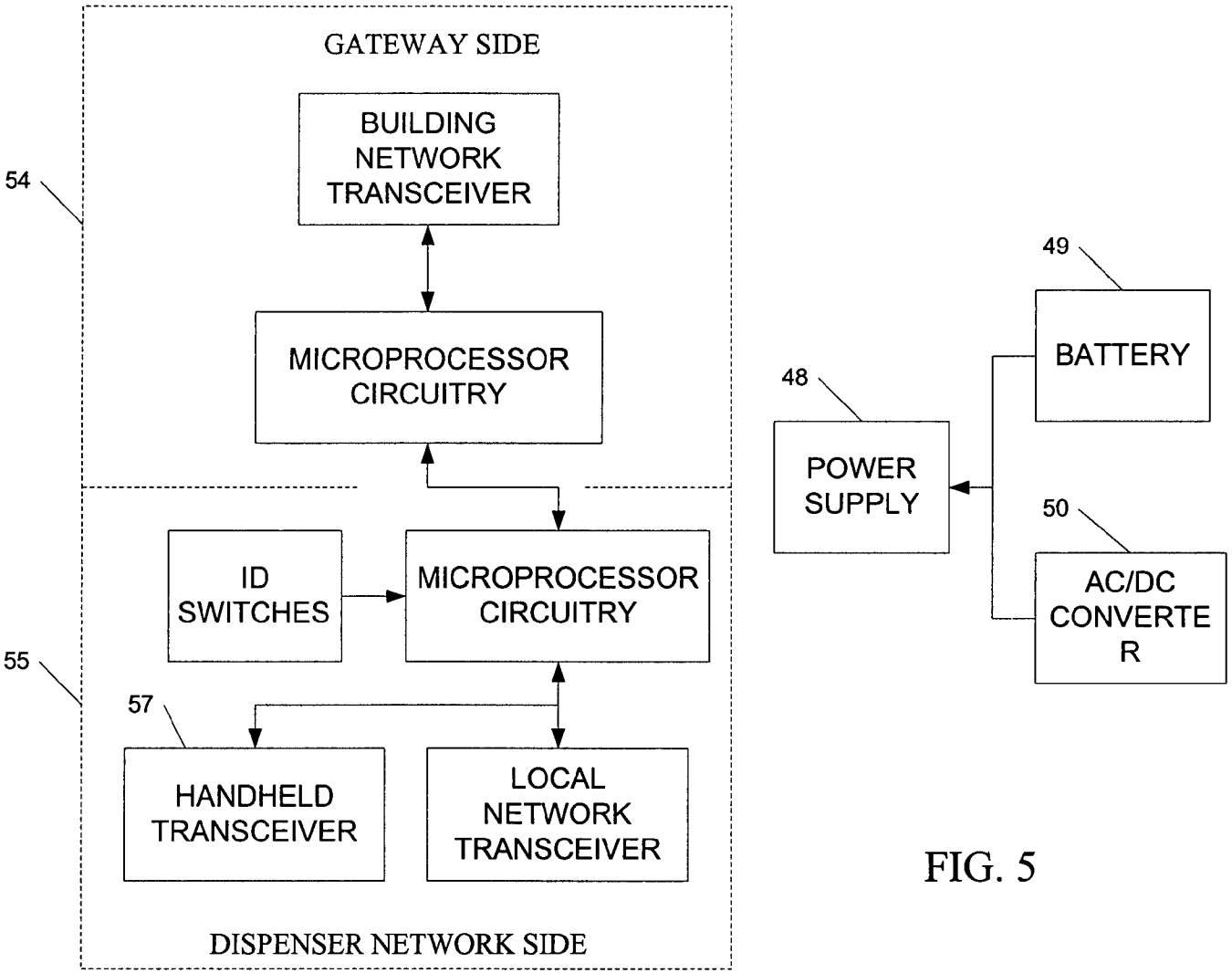
FIG. 5 illustrates a block diagram of a master network device for the intelligent dispensing system in accordance with an exemplary embodiment of the present invention.

The intelligent dispensing network system 100 includes a master network device 36 that can be attached to a ceiling plane or in close proximity to the group of dispensers 30-35. It is situated to yield the best signal strength when using RF or IR transceivers. The master network device 36 provides the common data collection point (the server) for the dispenser units 30-35 located in each local network area 39. FIG. 5 illustrates, in block diagram form, the components of the master network device 36. One section of the master network device 36 is the network server 55 for the local IDNS. This processor is responsible for requesting and receiving dispenser status and parameter data sent via the local network 39. The transmitted data is interpreted and presented to a second processor 54 which forms a gateway connection to the building communications network 38. The primary purpose of the gateway is to convert one communications protocol to another. With this method of interfacing different networks, the IDNS can be adapted to support existing and future standard networks commonly used in building communications networks.

Another feature of the master network device 36 is a separate transceiver 57 to support use of a handheld computing device 37. This device can be a PDA, portable computer, or other display/keypad terminal. The communication medium between the master device network 36 and the handheld device 37 can be of a non-contact nature; such as RF or IR, or can be by a wired method, such as an Ethernet network interface or RS-232 connection. The medium and protocol can be different from that of the IDNS 100 and building communications network allowing greater flexibility in selecting a handheld device 37 to meet specific end-user needs.

Figure 6:
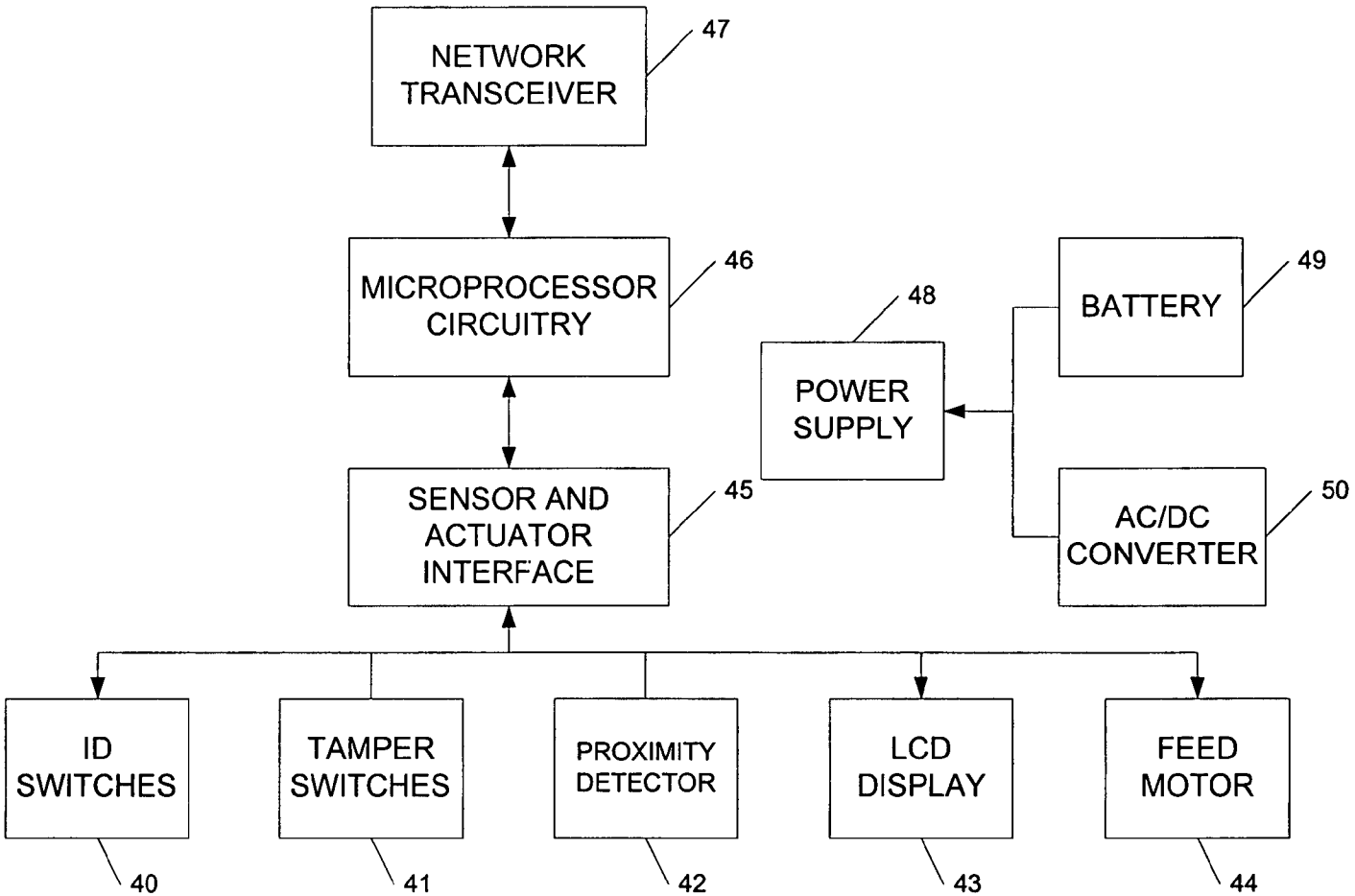
FIG. 6 illustrates a block diagram of an electronic control system contained within the dispenser in accordance with an exemplary embodiment of the present invention.

The electronic control system (controller) illustrated in FIG. 6 is responsible for controlling, monitoring, and reporting the operation of the dispensers 30-35. A microprocessor 46 executes an application specific program. The processor has interface circuitry 45 to adapt the signals of the dispenser sensors and actuators, converting these control signals to the proper voltage levels. The sensors 40, 41, 42 represent a collection of input devices in a building network environment used to detect a user request for paper, measure the length of paper fed, sense the position or misfeed of the paper, enter a setting for the dispenser network address, and detect unauthorized opening or tampering of the enclosure. The actuators represent a collection of output devices to operate the feed roller motor 44, and output textual status messages to an LCD display 43. The transceiver circuit 47 provides the interface between the local network medium (wire, RF, or IR) and the voltage levels of the microprocessor 46. A power supply 48 is used to convert either main current and/or battery power to the appropriate levels for the electronic circuitry.

In an exemplary embodiment, all data can be configured using the BACnet communications protocol although this does not limit the invention in any way. Other communications protocols can be used as well and without restricting the invention in any way.

Those skilled in the art will appreciate that many modifications to the exemplary embodiments of the present invention are possible without departing from the spirit and scope of the present invention. In addition, it is possible to use some of the features of the present invention without the corresponding use of other features. Accordingly, the foregoing description of the preferred embodiment is provided for the purpose of illustrating the principles of the present invention and not in limitation thereof, since the scope of the present invention is defined solely by the appended claims.

What is claimed is:

1. An apparatus for automatically dispensing a paper product, comprising:

a dispenser for dispensing the paper product;

a paper roll shaft/adapter positioned in a guide track inside the dispenser for holding a roll of the paper product;

an electric motor;

a single first roller for contacting an outer periphery of the roll and automatically unrolling a predetermined amount of the paper product from the paper roll when the dispenser is activated, wherein a position of a single peripheral surface of contact between the paper roll and first roller changes under gravitational assistance as the paper roll shaft/adapter travels in the guide track;

a second roller for guiding the paper product through a discharge chute of the dispenser; and a plurality of interconnected gears that are driven by the electric motor to activate the first roller and second roller to dispense the predetermined length of paper, and to operate each roller at the same speed.

2. The apparatus for automatically dispensing a paper product of claim 1 wherein the paper roll shaft/adapter operates under gravity-assistance as the amount of paper product remaining on the paper roll shaft/adapter decreases to maintain a substantially consistent frictional force between the first roller and the paper product.

3. The apparatus for automatically dispensing a paper product of claim 2 wherein the angle of the paper product applied to the first roller relative to a vertical line changes as a radius of the paper roll decreases with each dispensing of paper product from the paper roll.

4. The apparatus for automatically dispensing a paper product of claim 1 wherein the plurality of interconnected gears includes a motor gear, a middle gear engaged by the motor gear, a first roller gear engaged by the middle gear, and a second roller gear engaged by the middle gear.

5. The apparatus for automatically dispensing a paper product of claim 1 further comprising a battery for providing electrical power to the electric motor.

6. The apparatus for automatically dispensing a paper product of claim 5 wherein the battery is a rechargeable battery.

7. The apparatus for automatically dispensing a paper product of claim 1 wherein the dispenser comprises a cover and a liquid crystal display panel located on the cover.

8. The apparatus for automatically dispensing a paper product of claim 7 wherein the liquid crystal display panel provides an indication of a battery charge status and a paper product remaining status.

9. The apparatus for automatically dispensing a paper product of claim 1 further comprising an activation sensor to detect the presence of a user's hand below the dispenser for controlling the dispensing of paper product.

10. The apparatus for automatically dispensing a paper product of claim 1 further comprising a paper counter to determine the amount of paper product remaining on the paper roll.

11. The apparatus for automatically dispensing a paper product of claim 10 wherein the paper counter comprises a potentiometer and an arm that is positioned by the paper roll shaft/adapter as it the paper roll shaft/adapter travels down a curvature in the guide track towards the first roller.

12. The apparatus for automatically dispensing a paper product of claim 1 further comprising a microprocessor controller for determining an amount of paper product remaining on the paper roll shaft/adapter after each use.

13. The apparatus for automatically dispensing a paper product of claim 1 further comprising a pedestal mechanism for supporting the dispenser in a free-standing position.

14. An intelligent dispensing system for automatically dispensing and monitoring usage of a paper product, comprising:

a dispenser for dispensing the paper product;

a paper roll shaft/adapter positioned in a guide track inside the dispenser for holding a roll of the paper product;

an activation sensor to detect the presence of a user's hand in proximity to the dispenser for controlling the dispensing of paper product;

a single first roller for contacting an outer periphery of the roll and automatically unrolling a predetermined amount of the paper product from the roll when the dispenser is activated, wherein a position of a single peripheral surface of contact between the paper roll and first roller changes under gravitational assistance as the paper roll shaft/adapter travels in the guide track;

a second roller for guiding the paper product through a discharge chute of the dispenser; and a motor and gearing to activate and control operation of the first roller and the second roller to dispense the predetermined length of paper product through the discharge chute.

15. The intelligent dispensing system of claim 14 wherein the paper roll shaft/adapter operates under gravity-assistance as the amount of paper product remaining on the paper roll shaft/adapter decreases to maintain a substantially consistent frictional force between the first roller and the paper product.

16. The intelligent dispensing system of claim 15 wherein the angle of the paper product applied to the first roller relative to a vertical line changes as a radius of the roll decreases with each dispensing of paper product from the roll.

17. The intelligent dispensing system of claim 14 wherein the gearing comprises a motor gear, a middle gear engaged by the motor gear, a first roller gear engaged by the middle gear, and a second roller gear engaged by the middle gear.

18. The intelligent dispensing system of claim 14 further comprising a battery for providing electrical power to the motor.

19. The intelligent dispensing system of claim 18 wherein the battery is rechargeable.

20. The intelligent dispensing system of claim 14 further comprising a cover and a liquid crystal display panel located on the cover.

21. The intelligent dispensing system of claim 20 wherein the liquid crystal display panel provides an indication of a paper product remaining status.

22. The intelligent dispensing system of claim 14 further comprising a paper counter to determine the amount of paper product remaining on the roll.

23. The intelligent dispensing system of claim 22 wherein the paper counter comprises a potentiometer and an arm that is positioned by the paper roll shaft/adapter as it the paper roll shaft/adapter travels down a curvature in the guide track toward the first roller.

24. The intelligent dispensing system of claim 14 wherein each dispenser is either wall-mounted or pedestal-mounted.

25. The intelligent dispensing system of claim 14 further comprising:

a plurality of automatic paper product dispensers, with each dispenser including a microprocessor controller and a transceiver;

a master network device operatively connected with the transceiver in each dispenser; and a local network for enabling a paper product status message to be transmitted from each automatic paper product dispenser to the master network device.

26. The intelligent dispensing system of claim 25 further comprising an automation and control network interoperable with the local network for monitoring a status of each paper product dispenser.

27. The intelligent dispensing system of claim 25 wherein the master network device receives status messages from the transceiver in each dispenser.

28. The intelligent dispensing system of claim 27 wherein the master network device transmits status messages over the automation and control network.

29. The intelligent dispensing system of claim 25 wherein each automatic paper product dispenser and the master network device communicate with each other using wireless signals.

30. The intelligent dispensing system of claim 25 wherein the master network device and each dispenser transceiver use a wired connection for communication.

31. The intelligent dispensing system of claim 25 wherein the microprocessor controller for each paper product dispenser determines an amount of paper product remaining on the paper roll shaft/adapter and transmits a status message signal containing a status of the paper product to the master network device.

32. The intelligent dispensing system of claim 25 wherein the local network uses a standard data communications protocol.

33. The intelligent dispensing system of claim 32 wherein the automation and control network uses a building automation and control network protocol.

34. The intelligent dispensing system of claim 25 further comprising a handheld device for data communications with the master network device.

35. An intelligent dispensing system, comprising:

a dispenser apparatus including an activation sensor for automatically dispensing a predetermined amount of paper product in response to a detection of a user's hand in proximity to the dispenser and a microprocessor for monitoring usage of the paper product, wherein the dispenser apparatus further comprises:

a paper roll shaft/adapter positioned in a guide track inside the dispenser for holding a roll of the paper product;

a single first roller for contacting an outer periphery of the roll and automatically unrolling the predetermined amount of the paper product from the roll when the dispenser is activated, wherein a position of a single peripheral surface of contact between the paper roll and first roller changes under gravitational assistance as the paper roll shaft/adapter travels in the guide track; and a free-standing pedestal for supporting the dispenser apparatus.

36. The intelligent dispensing system of claim 35 wherein the dispenser further comprises:

a second roller for guiding the paper product through a discharge chute of the dispenser; and a motor and gearing to activate and control operation of the first roller and the second roller to dispense the predetermined length of paper product through the discharge chute.

37. The intelligent dispensing system of claim 35 wherein the paper roll shaft/adapter operates under gravity-assistance as the amount of paper product remaining on the paper roll shaft/adapter decreases to maintain a substantially consistent frictional force between the first roller and the paper product.

38. The intelligent dispensing system of claim 37 wherein the angle of the paper product applied to the first roller relative to a vertical line changes as a radius of the roll decreases with each dispensing of paper product from the roll.

39. The intelligent dispensing system of claim 35 further comprising a paper counter to determine the amount of paper product remaining on the roll.

40. The intelligent dispensing system of claim 39 wherein the paper counter comprises a potentiometer and an arm that is positioned by the paper roll shaft/adapter as the paper roll shaft/adapter travels down a curvature in the guide track toward the first roller.

41. The intelligent dispensing system of claim 35 wherein the free-standing pedestal comprises a base support, a shaft having a lower end mounted in the base support, a dispenser rear support attached to an upper end of the shaft and a dispenser cover that encloses the dispenser and attaches to the rear support.

42. The intelligent dispensing system of claim 41 wherein the dispenser cover comprises an LED display window for indicating an amount of paper remaining on the paper roll and a battery status display window for indicating remaining battery charge.

43. The intelligent dispensing system of claim 41 wherein the base support comprises a tripod mechanism.

44. The intelligent dispensing system of claim 41 wherein the shaft comprises a plurality of sections and a height adjustment mechanism to vary a height of the shaft between the base support and dispenser rear support.

45. The intelligent dispensing system of claim 44 wherein the plurality of sections comprises a straight lower section mounted in the base support and a straight upper section attached to the dispenser rear support.

46. The intelligent dispensing system of claim 44 wherein the plurality of sections comprises a straight lower section mounted in the base support and a curved upper section attached to the dispenser rear support.

47. The intelligent dispensing system of claim 41 wherein the shaft comprises a straight lower portion mounted in the base support and a straight upper portion attached to the dispenser rear support.

48. The intelligent dispensing system of claim 41 wherein the shaft comprises a straight lower portion mounted in the base support and a curved upper portion attached to the dispenser rear support.

* * * * *

UNITED STATES PATENT AND TRADEMARK OFFICE

CERTIFICATE OF CORRECTION

PATENT NO. : 7,370,824 B1
APPLICATION NO. : 11/120732
DATED : May 13, 2008
INVENTOR(S) : Charles Agnew Osborne It is certified that error appears in the above-identified patent and that said Letters Patent is hereby corrected as shown below:

On the Title Page Item (75) should read as follows:

Inventors: Charles Agnew Osborne, 7255 Gresham Trace, Cumming, GA (US) 30040

Tsu Ling Chang, 918 Robbins Way, Worthington, OH (US) 43085

Signed and Sealed this

Fifth Day of August, 2008

JON W. DUDAS
*Director of the United States Patent and Trademark Office*